United States Patent [19]

Mody

[11] Patent Number: 4,979,570

[45] Date of Patent: Dec. 25, 1990

[54] INFLATABLE TOOL WITH RIB EXPANSION SUPPORT

[75] Inventor: Rustom K. Mody, Houston, Tex.

[73] Assignee: Baker Hughes Incorporated, Houston, Tex.

[21] Appl. No.: 442,169

[22] Filed: Nov. 28, 1989

[51] Int. Cl.[5] ..... E21B 33/127

[52] U.S. Cl. ..... 166/387; 166/187; 277/34

[58] Field of Search ..... 166/387, 187; 277/34, 277/34.6

[56] References Cited

U.S. PATENT DOCUMENTS

| | | | |
|---|---|---|---|
| 3,289,761 | 12/1966 | Smith et al. | 166/187 X |
| 3,604,732 | 9/1971 | Malone | 277/34 X |
| 4,349,204 | 9/1982 | Malone | 166/187 X |
| 4,413,653 | 11/1983 | Carter, Jr. | 277/34 X |
| 4,768,590 | 9/1988 | Sanford et al. | 166/187 |
| 4,832,120 | 5/1989 | Coronado | 277/34 X |

*Primary Examiner*—William P. Neuder
*Attorney, Agent, or Firm*—Jackson & Walker

[57] ABSTRACT

An apparatus, such as a packer or bridge plug, and method of use, are provided for introduction into a subterranean well on a conduit. The apparatus has a cylindrical housing which may have upper and lower collars. An elastomeric seal is disposed around the exterior of the housing with a series of longitudinally extending ribs radially positioned around the housing. The ribs are outwardly and flexibly movable from retracted to expanded positions to anchor the apparatus in the well thereby resisting at least one of longitudinal and rotational movements. At least one elastically expandable belt is carried around the exterior of the ribs. When the sealing element, which includes a tubular elastic body, is moved for sealing engagement within the well by application of fluid, the belt expands and radially conforms the flexing movement of the ribs.

9 Claims, 2 Drawing Sheets

INFLATABLE TOOL WITH RIB EXPANSION SUPPORT

BACKGROUND OF THE INVENTION

1. Field of the Invention

The invention relates to inflatable devices, such as packers or bridge plugs, for use in subterranean wells.

2. Brief Description of the Prior Art

In the drilling, completion or workover operations of subterranean wells, it often becomes desirable to isolate one section of the well bore from another section of the well bore. In such event, a sealing tool, commonly referred to as a well packer, bridge plug, or the like, is used. Those skilled in the art are well familiar with such tools which have varying configurations.

One type of such well packer is an inflatable well packer which is run in the well on tubing wire line, or the like, and is sealingly engagable with the interior of casing set within the well, or, if the well is not set with casing, with the interior well bore wall, by means of application of well or other fluid under pressure to cause a tubular elastic body to expand radially outwardly. Such bodies are typically reinforced with a reinforcing sheath which has, in turn, secured around its exterior, approximate medial portion, a hardened rubber element which is the packing component, itself. Representative of such configurations can be found in patents assigned to Lynes, Inc., such as U.S. Pat. Nos. 3,604,732, and 3,837,947.

In recent years, some inflatable tools have been provided in designs in which the reinforcing ribs do not carry around their exterior the hardened rubber packer component such that when the apparatus is inflated to set the device within the well bore, the reinforcing component radially expands to act as an anchor against longitudinal and/or rotational movements of the apparatus in the well. In many such configurations, it has been found that the inflation of the tubular elastic body will cause the reinforcing component to radially expand such that the reinforcing component "kinks" as the ribs move outwardly such as do petals of a flower. Also, the inflation of tubular elastic body will cause uneven circumferential overlap of the reinforcing components such that some of the reinforcing components may not overlap as the ribs move outwardly creating an extrusion gap between the reinforcing components. When this occurs, the tubular elastic body will become vulnerable to cutting extrusion and abrasion if it is disposed between ribs during such action, resulting in a loss or decrease in inflation pressure and, in turn, he integrity of the seal established by the setting of the packer at such position within the well bore.

The present invention is directed toward an abatement of such problem by providing an apparatus and method wherein the expansion of the ribs is assisted by means of an expansion control belt surrounding the exterior of the ribs to conform their radial expansion movements.

SUMMARY OF THE INVENTION

The present invention provides an apparatus and method of use thereof with the apparatus being introduceable into a subterranean well on a tubular conduit. The well may be cased or uncased hole. The apparatus has a housing which may be defined with upper and lower collar members. Means, such as threads, are provided for securing the housing of the apparatus relative to the conduit which carries the apparatus into the well. An elastomeric sealing element is disposed around the exterior of the housing. Typically, the apparatus will also include an inner tubular elastic body longitudinally extending between the collars. Anchoring means are provided comprising a series of longitudinally extending rib-like members which are radially positioned around the housing and extending between the collar members. The anchoring means may extend from one of the collar members to the sealing element, or may extend from each of the collars to the sealing element. Alternatively, the anchoring means may extend from each of the collars through the sealing element, or from each of the collars between the sealing element and the tubular elastic body. The anchoring means is outwardly flexibly movable from a first retracted position during running in of the apparatus into the well to a second expanded position during sealing of the apparatus within the well for anchoring engagement of the apparatus at a location within the well to thereby resist at least one of longitudinal and rotational movements of the apparatus at that location.

Elastically expandable belt means are carried around the exterior of the anchoring means and are spaced between the inflatable elastomeric element at each of the collars, whereby upon inflation of the elastomeric element, the belt means expands and radially conforms the flexing movement of the anchoring means from the retracted to the expanding positions to abate the tendency of the anchoring means to "kink" or cut or otherwise cause abrasive action relative to the surface and/or interior of the tubular elastic body and/or the sealing element.

The apparatus is run into the well on a tubular conduit to a pre-determined location. Thereafter, an inflation fluid is introduced into the apparatus in a known manner to inflate the apparatus to cause the anchoring means to radially expand outwardly whereby the belt means conforms the flexing movement of the anchoring means. Inflation is continued until the elastomeric sealing element is sealingly engaged with the interior wall of the well bore or, when casing has been run, the internal diameter of the casing, to thereby isolate one portion of the well from another portion of the well.

DESCRIPTION OF THE PREFERRED EMBODIMENTS

Figure 1:
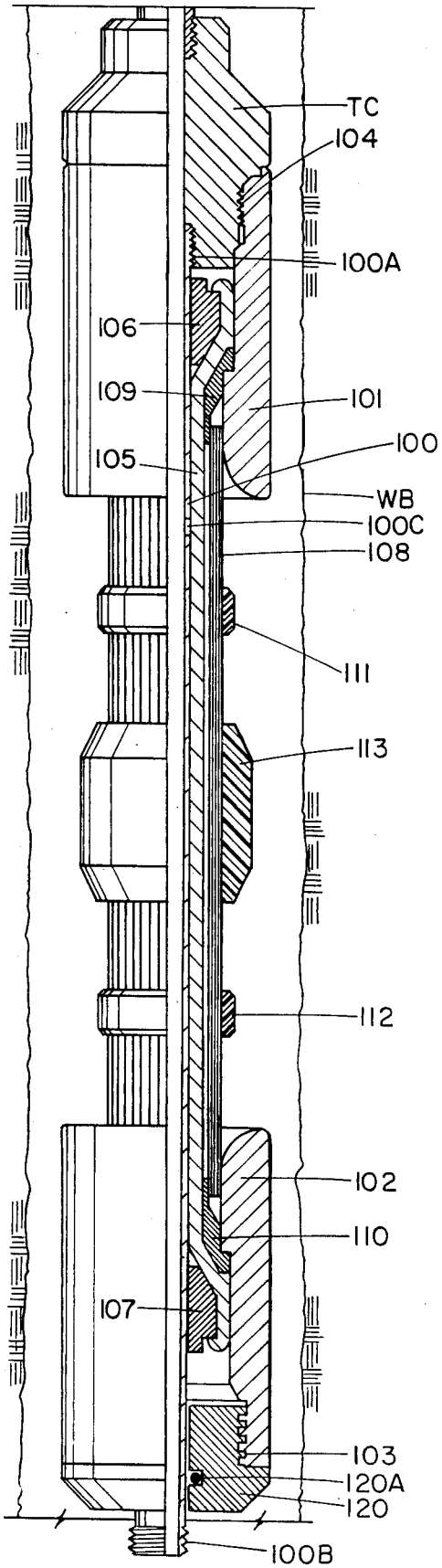
FIG. 1 is a longitudinally extending sectional view showing the apparatus run into the well prior to the setting action.

With reference to the drawings, there is disclosed an apparatus 10 positioned within a well bore WB and carried thereon on a tubular conduit TC. The apparatus 10 is comprised of a mandrel 100 together with an upper circumferentially extending collar member 101 at its uppermost end and a companion collar 102 at its lowermost end. The top collar 101, has threads 104, for threadably engaging the apparatus 10 to members extending a tubular conduit TC. Additionally, the top of the mandrel 100 is also threadably engaged to the tubular conduit connection TC at connection 100*a*. The mandrel 100 also has a series of injection portions 100*c* for communicating inflation fluid during setting of the apparatus 10.

The lower collar 102 normally is attached to a seal sub 120 having seal 120*a* which slides up the mandrel 100 as the apparatus 10 is being set within the well.

Threads 100*b* are provided on the lower end of the mandrel 100 for securement to an additional section of tubing conduit or another tool.

It will, of course, be appreciated that the apparatus 10 may be carried at the lowermost end of the tubular conduit TC, and if there are no other tools to be carried into the well bore WB below the apparatus 10, the threads 100*b* will not be used. Alternatively, the apparatus 10 may be disposed on the tubular conduit TC between members thereof, such that the threads 100*a* secure the apparatus 10 to the tubular conduit TC and a tubular member of the conduit TC extends below the apparatus 10 and is secured thereby at threads 100*b*.

Around the mandrel 100 is carried a longitudinally extending tubular elastic body member 105 secured within the upper collar 101 at its uppermost end by means of an upper securing ring 106 snugly engaging the body 105 in combination with an upper lock ring member 109. Likewise, the lowermost end of the tubular elastic body 105 is secured at its lowermost end by means of a companion lower securing ring 107 juxtapositioning the lowermost end of the tubular elastic body 105 within the lower collar 102 by means of the lower lock ring 110.

Implaced circumferentially around the tubular elastic body 105 is an anchoring means 108 comprised of rib elements 108*a*. As shown, the anchoring means 108 has its uppermost end extending within the interior of the upper collar 101 and secured relative thereto by welding or other conventional securing means to the lock ring 109. The lowermost end of the anchoring means 108 is snugly secured within the interior of the lower collar 102 and is likewise affixed to the lower lock ring 110. The anchoring means 108 is shown with a sealing element 113 or "packer" implaced in the medial position of the anchoring means 108. As shown, each of the ribs 108*a* longitudinally extend from the interior of the upper collar 101 to the interior of the lower collar 102 and through or interior of the sealing element 113.

It will be appreciated that the ribs 108*a* need not be one continuous length and could be positioned such that they extend from the upper collar 101 to the sealing element 113 or, alternatively, from the lower collar 102 to the sealing element 113, depending upon the anchoring and/or other objectives to be served by actuation of the means 108.

The anchoring means 108 may be formed of any suitable material to accomplish the results desired and which will withstand the temperatures encountered during operation of the apparatus 10 within the well bore WB. The anchoring means 108 is also a reinforcing sheath for the tubular elastic body 105 and is preferably formed of longitudinally extending strips or ribs 108*a* which are of a suitable length so that they extend between each of the collars 101, 102. It will be noted that each of the longitudinally extending ribs 108*a* circumferentially overlap an adjacent rib 108*a*. The width of the strips and their arrangement in forming the anchoring means or reinforcing sheath 108 is such that each of the strips will overlap the next adjacent strip when the inflatable elastic body 105 is deflated and each strip will overlap the next adjacent strip when the inflatable member 105 is inflated, thus forming the reinforcing sheath-like structure at all times.

As discussed earlier, the length of the ribs 108*a* and their comparative thinness may result in a tendency to "kink" during inflation of the tubular elastic body 105 thus permitting the body 105 to come in between respective rib members 108*a*, thus causing punctures within the elastic body 105 and a loss in the integrity of the sealing element 113 as the inflation of the apparatus 10 is adversely effected.

Depending upon the use for which the apparatus 10 is constructed, the base material of the ribs 108*a* may be of flat braided wire impregnated with elastomer or plastic, strips of plain woven fiberglass which may or may not be impregnated with elastomer or plastic, strips of plain or woven nylon, strips of spring steel, strips of metal, such as ordinary mild steel, stainless steel, or other permanently deformable material, strips of other plain or woven material, such as teflon or other plastics, depending upon the pressure to which the inflatable apparatus 10 is to be inflated.

The sealing element 113 is of known construction, and may be any hardened rubber or other sealing material, such as plastic, which is bonded or otherwise permanently secured around the anchoring means 108.

As shown, the apparatus 10 contains upper and lower donut shaped circumferentially extending belt members 111, 112 respectively positioned adjacent the sealing element 113 and between the upper and lower collar members 101, 102. The belts 111, 112 should be formed of a rubber or other elasticized material which will conform to the radial expansion of the rib members 108*a* as the anchoring means 108 is flexed outwardly during inflation of the tubular elastic body 105. By use of the belt members 111, 112, the "kinking" of the ribs 108*a* is resisted to permit conformed and uniformed radial outward expansion of the ribs 120 without cutting or tearing into the elastic body 105.

Although preferable, it is not necessary that the belts 111, 112 be placed medially between the sealing element 113 and the respective collars 101, 102. The belts 111, 112 may be placed at any position along the anchoring means 108 but, preferably, will be positioned adjacent the medial point between the sealing element 113 and the respective collar 101, 102.

The belts may be placed on the tool in any desired number and may be positioned thereon as desired. The construction, number and location of the belts 111, 112 should be such that they will not adversely affect the integrity of the seal provided by the sealing element 113 with the well bore WB.

Figure 2:
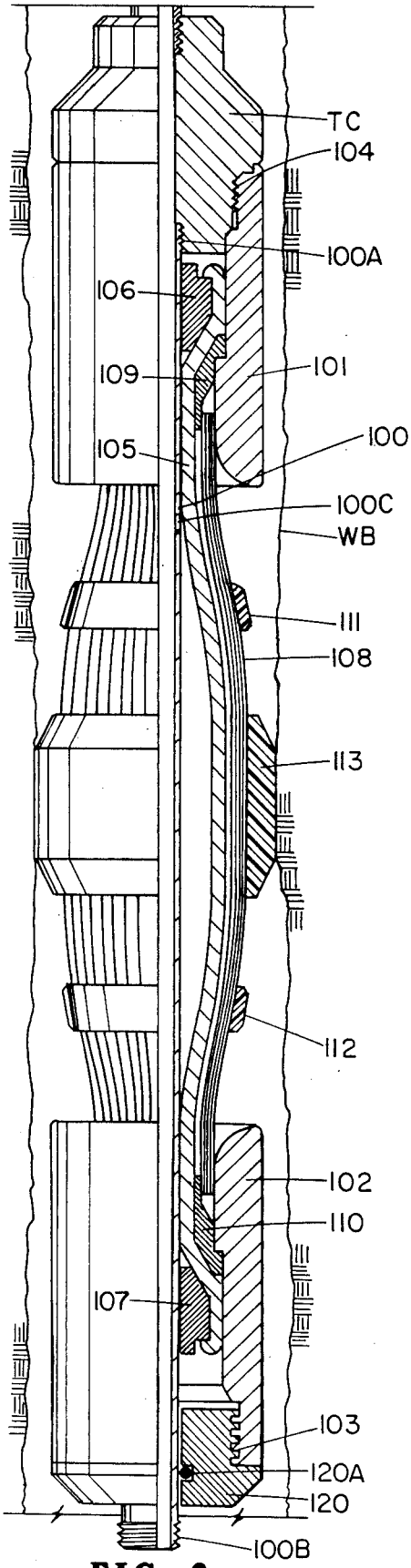
FIG. 2 is a view similar to that of FIG. 1 showing the apparatus as it is being moved to its set position.
Figure 3:
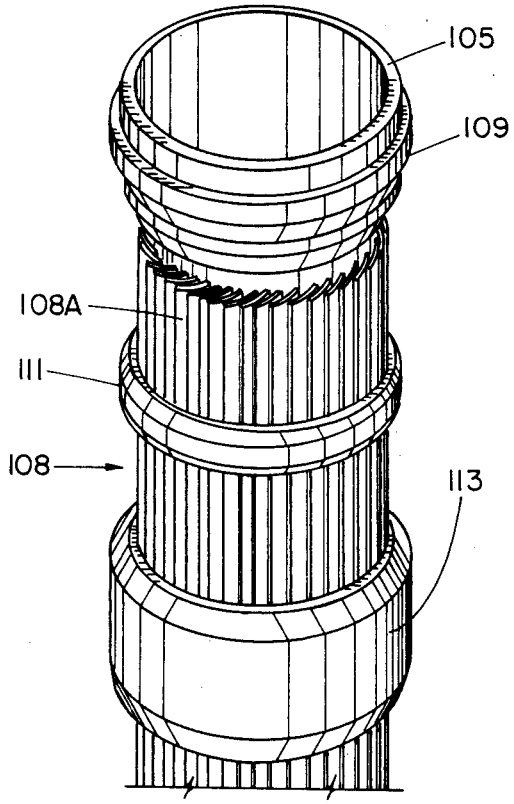
FIG. 3 is a perspective view of the elastic sealing element and the belt means in the position of the tool as shown in FIG. 1.
Figure 4:
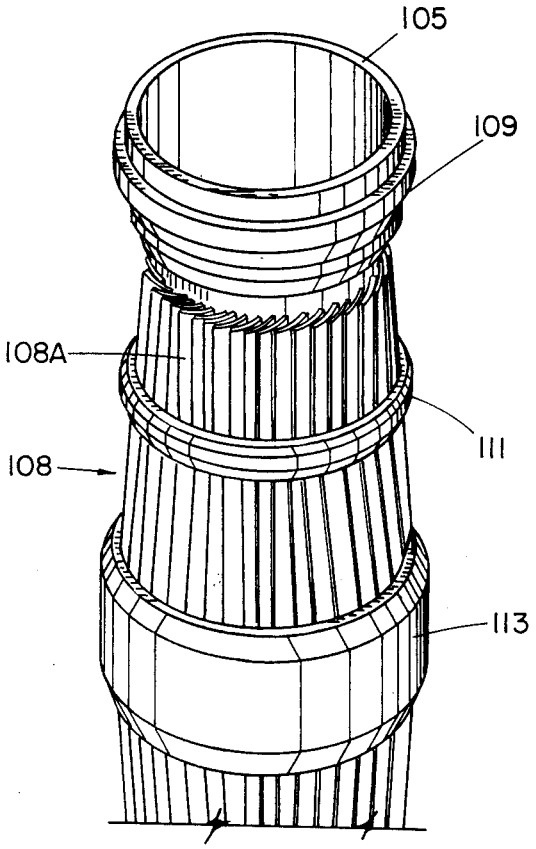
FIG. 4 is a view similar to that of FIG. 3, illustrating the action of the tubular elastic body, the anchoring means and the belt means as the tool is moved to the position shown in FIG. 2.

During setting, the ribs may expand sufficient to provide anchoring contact with the well bore, although the view depicted in FIG. 2 does not illustrate such ribs completed extended to such position.

During the setting of the apparatus 10, fluid will be introduced through the tubular elastic body 105 in a known manner. The belts 111, 112, urge the anchoring means 108 into the retracted, or running position as shown in FIG. 1, while expansion of the tubular elastic body 105 urges the anchoring means 108 outwardly. The combination of these two forces assist the anchoring means 108 during the setting procedure such that the ribs 108a will not flex or bend and are thereby supported to prevent "kinking", i.e. a flexing or bending action which includes some axial rotation of the rib 108a which might cause the tubular elastic body 105 to be urged in between rib members 108a and pinched to cause a hole or slight inflection in the body 105 ultimately resulting in a puncture or leak.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. Apparatus for introduction into a subterranean well on a conduit, comprising:

(a) a cylindrical housing including upper and lower collar members;

(b) means for securing said housing relative to said conduit;

(c) an inflatable elastomeric element disposed around the exterior of said housing;

(d) anchoring means comprising a series of longitudinally extending rib members radially positioned around said housing and extending between said collar members and through said elastomeric element and outwardly flexibly movable from a first retracted position during running in of said apparatus into said well to a second expanded position during setting of said apparatus within said well, for anchoring engagement of said apparatus at a location within said well to thereby resist at least one of longitudinal and rotational movements of said apparatus at said location; and (e) elastically expandable belt means carried around the exterior of said anchoring means and spaced between said inflatable elastomeric element and each of said collars, whereby upon inflation of said elastomeric element, the belt means expands and radially conforms the flexing movement of the anchoring means from the retracted to the expanded positions.

2. The apparatus of claim 1 wherein the anchoring means comprises a series of thin metal strips.

3. Apparatus for introduction into a subterranean well on a conduit, comprising:

(a) a cylindrical housing including upper and lower collar members;

(b) means for securing said housing relative to said conduit;

(c) an inflatable elastomeric element disposed around the exterior of said housing;

(d) anchoring means comprising a series of longitudinally extending rib members radially positioned around said housing and extending from at least one of said collar members and outwardly flexibly movable from a first retracted position during running in of said apparatus into said well to a second expanded position during setting of said apparatus within said well, for anchoring engagement of said apparatus at a location within said well to thereby resist at least one of longitudinal and rotational movements of said apparatus at said location; and (e) elastically expandable belt means carried around the exterior of said anchoring means, whereby upon inflation of said elastomeric element, the belt means expands and radially conforms the flexing movement of the anchoring means from the retracted to the expanded positions.

4. The apparatus of claim 3 wherein the anchoring means comprises a series of thin metal strips.

5. Apparatus for introduction into a subterranean well on a conduit, comprising:

(a) a cylindrical housing including upper and lower collar members;

(b) means for securing said housing relative to said conduit;

(c) an inflatable elastomeric element disposed around the exterior of said housing;

(d) anchoring means comprising a series of longitudinally extending rib members and outwardly flexibly movable from a first retracted position during running in of said apparatus into said well to a second expanded position during setting of said apparatus within said well, for anchoring engagement of said apparatus at a location within said well to thereby resist at least one of longitudinal and rotational movements of said apparatus at said location; and (e) elastically expandable belt means carried around the exterior of said anchoring means whereby upon inflation of said elastomeric element the belt means expands and radially conforms a flexing movement of the anchoring means from the retracted to the expanded positions.

6. The apparatus of claim 5 wherein the anchoring means comprises a series of thin metal strips.

7. Apparatus for introduction into a subterranean well on a conduit, comprising:

(a) upper and lower collar members;

(b) means for securing said apparatus relative to said conduit;

(c) an inner tubular elastic body longitudinally extending between said collars;

(d) elastomeric sealing means disposed around the exterior of said apparatus;

(e) anchoring means comprising a series of longitudinally extending rib members radially positioned around said apparatus and extending from at least one of said collar members to said elastomeric sealing element and outwardly flexibly movable from a first retracted position during running in of said apparatus into said well to a second expanded position during setting of said apparatus within said well for anchoring engagement of said apparatus at a location within said well to thereby resist at least one of longitudinal and rotational movements of said apparatus at said location; and (f) elastically expandable belt means carried around the exterior of said anchoring means whereby, upon inflation of said inner elastic body, the belt means expands and radially conforms the flexing movement of the anchoring means from the retracted to the expanded positions and resists cutting of said tubular elastic body.

8. The apparatus of claim 7 wherein the anchoring means comprises a series of thin metal strips.

9. Method of sealing a portion of a subterranean well, comprising the steps of:

(1) assembling at the top of the well a conduit having affixed thereon a sealing apparatus, said sealing apparatus comprising:

(a) upper and lower collar members;

(b) means for securing said apparatus relative to said conduit;

(c) an inner tubular elastic body longitudinally extending between said collars;

(d) elastomeric sealing means disposed around the exterior of said apparatus;

(e) anchoring means comprising a series of longitudinally extending rib members radially positioned around said apparatus and extending from at least one of said collar members to said elastomeric sealing element and outwardly flexibly movable from a first retracted position during running in of said apparatus into said well to a second expanded position during setting of said apparatus within said well for anchoring engagement of said apparatus at a location within said well to thereby resist at least one of longitudinal and rotational movements of said apparatus at said location; and (f) elastically expandable belt means carried around the exterior of said anchoring means whereby, upon inflation of said inner elastic body, the belt means expands and radially conforms the flexing movement of the anchoring means from the retracted to the expanded positions and resists cutting of said tubular elastic body;

(2) running said apparatus on said conduit within said well to a pre-determinable position within said well;

(3) actuating said sealing apparatus by introduction of fluid to expand said tubular elastic body whereby the belt means expands to radially conform the flexing movement of the anchoring means from the retracted to the expanded positions to anchor the apparatus to resist at least one of longitudinal and rotational movements of said apparatus, and said elastomeric sealing element is in sealing position relative to said well bore at said position.

* * * * *